US005451046A

United States Patent [19]

Batton

[11] Patent Number: 5,451,046

[45] Date of Patent: Sep. 19, 1995

[54] FLAG FOOTBALL EQUIPMENT

[76] Inventor: Rodney Batton, 931 S. Trident #F, Anaheim, Calif. 92804

[21] Appl. No.: 312,692

[22] Filed: Sep. 27, 1994

[51] Int. Cl.[6] ..... A63B 43/02; A63B 37/14; A63B 37/06

[52] U.S. Cl. ..... 273/55 C; 273/65 EG; 273/DIG. 30; 273/DIG. 24; 273/DIG. 20

[58] Field of Search ..... 273/65 EG, 65 ED, 65 R, 273/65 EC, 65 EF, DIG. 30, DIG. 24, DIG. 20, 55 R, 55 C

[56] References Cited

U.S. PATENT DOCUMENTS

| | | | |
|---|---|---|---|
| 2,966,356 | 12/1960 | Wilson et al. | 273/55 C |
| 3,063,718 | 11/1962 | Steinkamp | 273/55 C |
| 3,953,030 | 4/1976 | Muchnick | 273/95 |
| 4,303,247 | 12/1981 | Fain | 273/324 |
| 4,772,020 | 9/1988 | Martin | 273/65 EG X |
| 4,801,141 | 1/1989 | Rumsey | 273/1 |
| 5,183,263 | 2/1993 | Kuebler | 273/65 EG |
| 5,228,690 | 7/1993 | Rudell et al. | 273/65 |

*Primary Examiner*—George J. Marlo

[57] ABSTRACT

Flag football equipment wherein a soft foam rubber football includes helical finger receiving gripping grooves containing loop fabric fasteners, a waist encircling belt including a plurality of detachable flags containing loop fabric fasteners, and a glove including hook fabric fasteners for interlocking engagement with the loop fabric fasteners on the football and flags. The football may also include whistles located at a point midway between its ends, and the loop fabric fasteners may be colored with a non-toxic fluorescent glow-type coating.

16 Claims, 4 Drawing Sheets

FLAG FOOTBALL EQUIPMENT

BACKGROUND OF THE INVENTION

1. Field of the Invention

The present invention relates generally to the field of amusement equipment for a flag football game. In particular, this invention relates to an improvement of the flag football game to provide a fluorescent light and sound producing football with superior throwing and catching capabilities, making the game easier and more enjoyable, and particularly to a variation in the design of the exterior surface of the football and the corresponding glove to effect the spiral motion of the football as it leaves the grip of the thrower and for easier catching. Additionally, this invention relates to a novel belt with flags for improved tagging and to an improved coupling for such a device to the player's belt. The football and the gloves have plurality of strips made of the material commonly called VELCRO and flags are totally covered with VELCRO.

2. Brief Description of the Prior Art

Football games utilize chasing and catching abilities and demand sophisticated strategy and developed physical and motor skills. Tackle football, due to extensive falling and rolling on the ground, demands heavy bodily contact and use of safety equipment. Flag football was developed as an alternative game, safe and exciting for people of all ages. Stopping of the football player carrying the football is accomplished by removing a flag from his body. Each player has a set of flag devices that flutter around his body to be difficult to catch and designed so that they require certain amount of pull-away force to accomplish deflagging.

In prior flag type games, a flag has typically been attached to the belt by releasable coupling parts. In the U.S. Pat. No. 4,651,989 issued to Wilson, these coupling parts were disclosed, designed as cooperative ball and socket devices, secured by suction, and made of plastic. Excessive force and skill is required to re-insert the ball in the socket in the middle of the game, causing a problem for young and handicapped players. In the excitement of the game the person wearing the belt with the flags might not notice the deflagging and continue playing, thereby delaying the game, if the coupling device is too easy to separate. In addition, belts in the prior art use buckles and have to be constructed in different sizes for smaller and adult players.

In the game of football, in order to effectively throw the football, it is necessary to release the football in such a manner to produce a spiraling motion of the football as it travels through the air, spinning around its roll axis. Conventional football lacing is often inadequate for a grip, especially for less experienced players.

In order to help performance of the children, Parker Brothers produced NERF TURBO FOOTBALL, an elastic foam football with lengthwise spiral grooves increasing in width and depth towards the middle of the football for improved handling. This elliptical football is soft, lightweight, allowing easier handling and safer football game. The ribs between the grooves stabilize football spinning and result in a better football aerodynamic performance.

VELCRO coverings on objects such as balls have been in use for decades. Children's baseballs, footballs, gloves, flying discs and catching paddles were marketed where the entire surface of the balls and many areas on the gloves were covered with VELCRO in order to improve ability to catch. In this design, however, it was impossible to throw the object with the corresponding gloves, due to the fact that the ball's entire surface was covered with VELCRO and the attachment between the glove and the ball was very tight.

For example, U.S. Pat. No. 5,183,263 issued to Kuebler describes a foam rubber football fully covered with VELCRO, with additional thin strips of VELCRO material glued on each of the football's four seems. A cotton glove, accompanying the ball, has rubber coated palm surface with thin strips of VELCRO hook material glued on each of the fingers. The football is catched with a gloved hand but has to be thrown with an ungloved hand.

U.S. Pat. No. 3,953,030, issued to Muchnick, describes a throw and catch toy comprising a ball having VELCRO patches and a very large, inflatable glove with VELCRO patches, allowing catching and holding the ball without grasp of the fingers. It is to be used for young children or mentally retarded persons, learning to catch the ball.

U.S. Pat. No. 4,303,247 issued to Fain, discloses a device where the ball has hook and loop fasteners, such as VELCRO, while the surface of the device for catching the ball has a series of fasteners complimentary to those on the ball.

U.S. Pat. No. 5,228,690 issued to Rudell, discloses a football with an appendage for the purpose of both a stabilizing function to improve directional throwing as well as to provide a grip surface for catching, holding while practicing kicking or for grabbing by an opponent. The VELCRO is applied on two removable sections of a ball projectile to provide separation removable attachment of those sections.

In addition, U.S. Pat. No. 4,801,141 issued to Rumsey, discloses a light and sound producing ball wherein an electronic circuit board controls the light and sound.

SUMMARY OF THE INVENTION

It is an object of this invention to provide novel equipment for flag football and comparable games enabling separation of the flags from a player's belt with considerable and adequate tension and ensuring secure coupling time and time again.

It is another object of this invention to provide equipment for flag football and comparable games that enables easy separation of the flag from a player while ensuring secure coupling on a repetitive basis.

It is yet another objective of the invention to improve a football to render it easier to produce a spiralling motion to the football, to travel straighter and further, and to improve its aerodynamics.

Another object of the present invention is to provide football thrower with a glove that interacts with the special football of this invention to improve the throw and catching of the football of this invention.

It is a further object of this invention to provide a football which is modified to be used as a training aid for throwing a football.

Another object of this invention is to provide a football for easy teaching and use by all ages to improve spiral throw through the air and to make football travel straighter and with greater velocity.

It is also an objective of this invention to provide a football for use by less capable players, particularly children and handicapped persons with impaired vision, hearing and motor skills, that is easier to throw and control than conventional footballs.

It is also an objective of this invention to provide a football that exhibits pretty colors and is attractive to the players and the observers, with fluorescent light glowing at night.

In carrying out the above objects and other objects of this invention an amusement game flag football is presented, able to accommodate a group of people for a synchronized playing. An entertaining effect can be obtained by an improved belt for displaying the flags used in playing flag football and other tagging games.

This invention comprises a special football with plurality of sound devices and fluorescent strips, attached to the exterior of the football, a corresponding glove and a belt with flags worn by each player. The football and the gloves have plurality of strips made of the material commonly called VELCRO. Flags are totally covered with VELCRO. To our knowledge, the employment of VELCRO in flag football, making it easier to throw the football and easier to catch the football and/or the flag, and thereby making a game easier and more enjoyable, has never before been suggested.

The football of the present invention is similar to NERF football, especially adapted with VELCRO strips for better spiralling movement and easier throwing. The glove has VELCRO strips on its palm side, to which the VELCRO material on football adheres upon contact, so that a beginner can succeed in catching the football almost from the start and acquire coordination later useful in football. When the football impacts on the catcher's mitt, the football releasingly attaches thereto.

The present device combines the excitement of a sound device and a football without the need of an electronic circuit. In the preferred embodiment, a football with sound devices and fluorescent strips and accompanying glove and belt are presented for enhanced entertainment at an economical manner. The air passes through whistle mechanism at the external surface of the football and is discharged. As the air flows through the whistle mechanisms on the exterior of the football, the whistles produce sound when air travels relative to the sound devices. The quality of the sound is responsive to the skills of the operator and this feature is particularly useful for the blind players. Fluorescent strips provide the light in the evenings and at night. Coloring is of non-toxic fluorescent glow coat finish which produces a glow effect in a darkened environment.

The belt may be a wide or thin belt, with safe VELCRO buckling and color easily seen over the play area. Automatic and instantaneous adjustment to all waist sizes is incorporated into this design by making both belt surfaces of cloth material and belt closure of VELCRO. In addition, on detachment of VELCRO, a loud noise can be heard which improves the game for spectators or officials by providing instant proof of deflagging. In one preferred embodiment of the invention, the VELCRO completely covers the inside of the grooves in the football surface. In another embodiment of the invention, the VELCRO is only applied to the two slanted walls of the grooves, in which case the grip becomes even firmer.

DESCRIPTION OF THE DRAWINGS

The features of the present invention can be best understood together with further objectives and advantages by reference to the following description, taken in connection with the accompanying drawings, wherein like numerals indicate like parts.

DESCRIPTION OF THE INVENTION

In the following description, numerous specific details are set forth in order to provide a more thorough description of the invention. It will be apparent, however, that the present invention may be practiced without these specific details. In other instances, well known features have not been described in detail so as not to unnecessarily obscure the present invention.

The present invention provides an amusement to the people of all ages, including small children and handicapped individuals, resulting in a feeling of joy and in an experience of participating in the activity. It is to be utilized in parks, school playgrounds, inside the home and the like.

Figure 1:
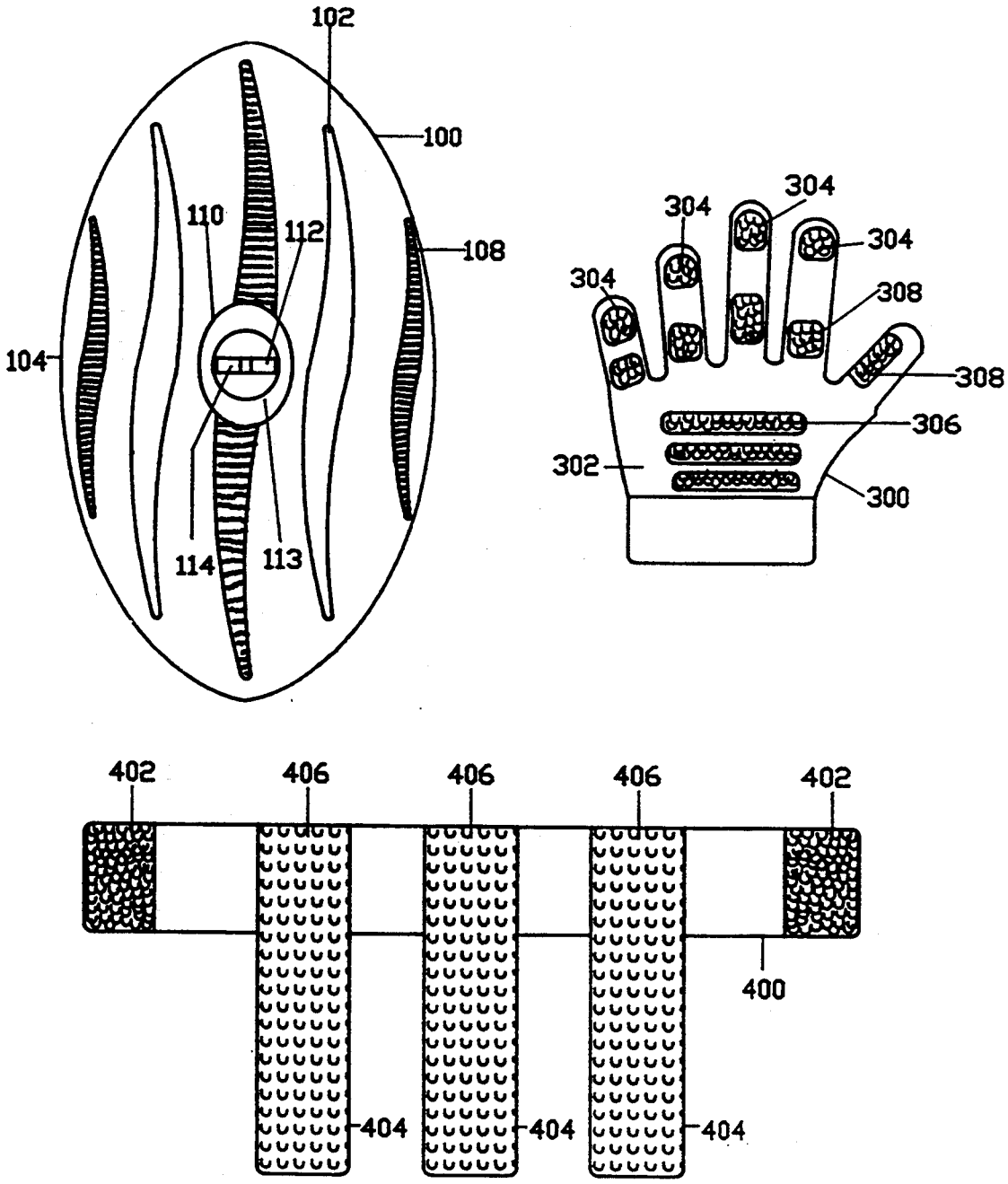
FIG. 1 is a plan view of a football, glove and a belt in accordance with one embodiment of the present invention.

Flag football is one variant of football played by children and involves chasing the opponent player who is holding a football and then grabbing a cloth or vinyl flag, attached to that player's belt, to signify a tackle. FIG. 1 illustrates a plan view of a football, glove and a belt in accordance with one embodiment of the present invention.

Figure 2:
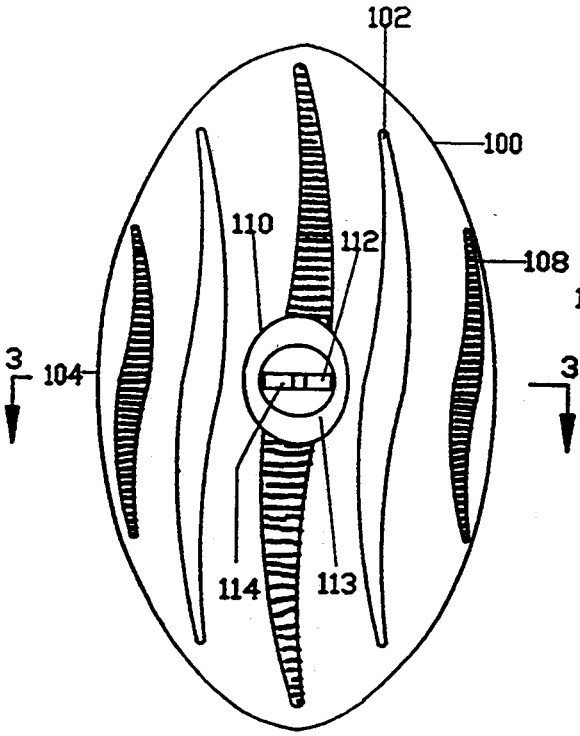
FIG. 2 is a plan view of a football, in accordance with one embodiment of the present invention.
Figure 3:
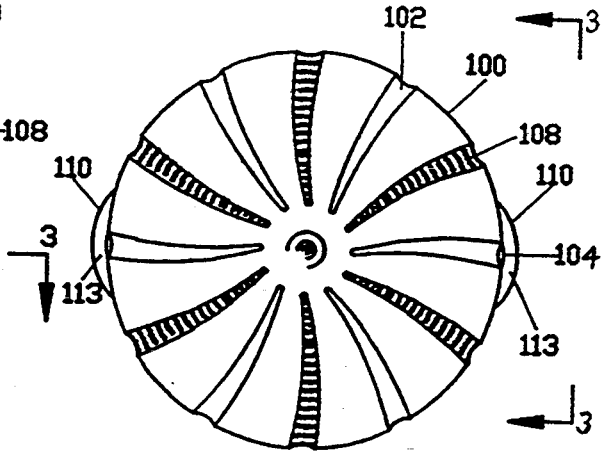
FIG. 3 shows a cross-section of the football on FIG. 2 along line 3—3, in accordance with one embodiment of the present invention.

The foam rubber football 100, shown in FIG. 2, is produced in the standard spray foam injection mold process. It is a one piece molded elliptical type football 100 of, for example, polyurethane, foam rubber, or other type of soft, lightweight elastic foam. It preferably has twelve equally spaced longitudinal elliptic-helical grooves 102 in its surface, as shown in FIG. 3. In the preferred embodiment, the grooves are deepest in the middle 104 of the football 100, become shallower and narrower towards the end 106 of the football 100 and end at approximately 1½ inch from each end 106 of the football 100.

The football 100 is modified to bear several strips 108 of VELCRO, attached inside some of the football grooves 102. The strips 108 can be 0.25 to 0.5 inches wide and affixed using an adhesive or sewn onto the outer surface of the football 100.

VELCRO, used in this invention, is the two component fastening system, manufactured by the Velcro Manufacturing Company of Manchester, N.H., and sold under the trademark VELCRO. Fastening of VELCRO strips can be accomplished by sewing, by adhesives, by heat sealing and other textile joining processes.

Two component fastening system comprises a first component, including a plurality of loop elements projecting therefrom, and a second component including plurality of hook elements projecting therefrom. The first and second component are arranged to be releasably secured to each other upon contact. By pulling on the components, they can be readily separated.

VELCRO strips 108 in the present invention are placed in every other of twelve grooves 102. VELCRO strips 108 stop 1½ inch from the ends 106 of the football 100. They are color coordinated with the football 100 so that they cannot be seen in the daylight. However, the strips 108 are fluorescent and they glow in the dark.

Grooves 102 in the football 100 exterior are U-shaped in cross section, with two slanted walls and an approximately horizontal bottom, and are wide and deep enough to allow a player, not shown, to place the fingers inside the grooves 102, in order to accomplish a high degree of gripping. In addition, VELCRO strips 108, applied on the football grooves 102, enhance gripping by accompanied glove 300, shown in FIG. 4, more easily, more quickly and more securely. This results in more forceful, longer and better passes and easier receiving and carrying of the football 100 then accomplished in prior art.

Figure 6:
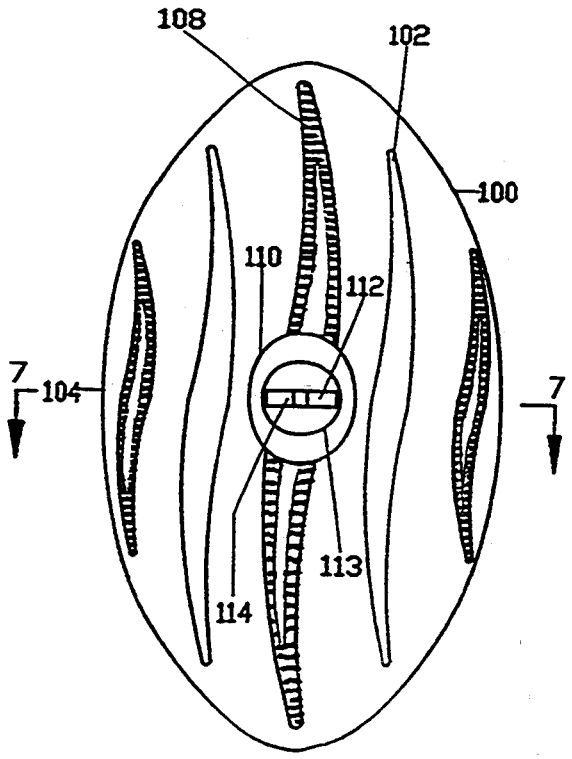
FIG. 6 is a plan view of a football, in accordance with another embodiment of the present invention.
Figure 7:
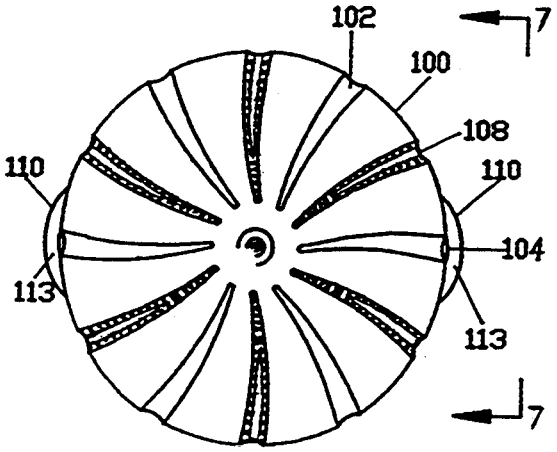
FIG. 7 shows a cross-section of the football on FIG. 6 along line 7—7, in accordance with another embodiment the present invention.

Further, the force applied by fingers to the side of the groove 102 does not require much friction to rotate the football 100 and the football 100 with grooves 102 is easier to use for the children who lack strong grip. Moreover, the grooves 102 stabilize the flight when football 100 is thrown with the spinning motion. In one preferred embodiment of the invention, shown in FIGS. 3 and 4, the VELCRO completely covers the inside of the groove 102. In another embodiment of the invention, shown in FIGS. 6 and 7, the VELCRO is only applied to the two slanted walls of the groove 102, in which case the grip becomes even firmer.

Figure 5:
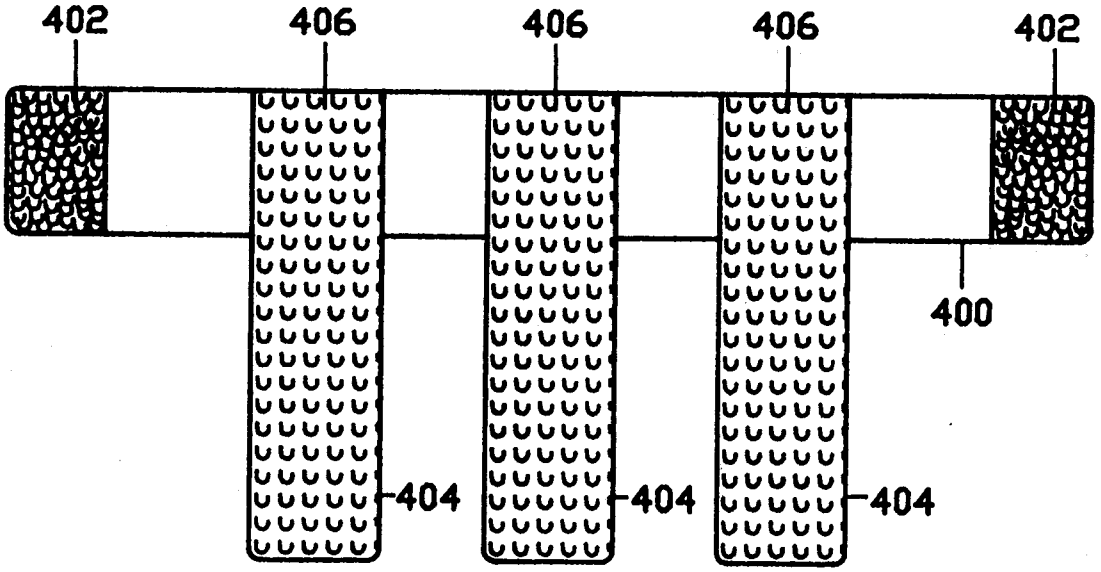
FIG. 5 is a plan view of a belt of the present invention.

FIG. 5 illustrates a preferred belt 400 design, in accordance with the invention. The preferred belt 400 shown has two buckles 402 and three flags 404, removably attached to the belt 400 with co-acting attachment tabs 406 made of VELCRO. Flag 404 is long and narrow, constructed of a strip of a durable, flexible material such as vinyl, cloth or the equivalent. This allows flag 404 to flex and twist around player's body, yet maintains its length and strength. Flag 404 can be between 12 and 22 inches long and between 1½ and 3 inches wide, in order to accommodate different players' waist size, or it can have any similar dimensions.

Flag 404 is completely covered with VELCRO loop material, functions as a tail, and is fixedly and securely attached to the belt 400 with attachment tab 406 formed of hook VELCRO material. In this embodiment, tabs 406 are 1 inch square, but the size and configuration of each of the VELCRO tabs 406 in this invention can vary. The VELCRO tabs 406 are all fixably attached to the belt 400 by either non-removable adhesive or by stitching.

Hook VELCRO fabric can also be used with fabrics other than the co-acting VELCRO loop fabric, like tricot, wool or cotton flannel. In the preferred embodiment of the present invention, both the inside of the belt 400 and its outside is made of one of such fabrics to insure easy belt 400 closure, adaptable to players of all waist sizes. Therefore, the buckle 402 is made of VELCRO, located on the outside of one of the ends of the belt 400. The closure of the belt 400 is accomplished by pressing the buckle 402 to the inside of the belt 400. Another buckle can be located at the inside of the other end of the belt 400, in order to accomplish shortening of the belt 400 size and avoid the belt 400 end to hang loosely.

Figure 4:
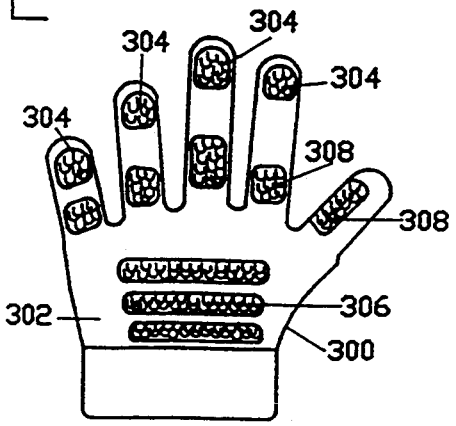
FIG. 4 is a plan view of a glove, in accordance with the present invention.

FIG. 4 illustrates a glove 300 of the invention, shown from the palm side. The glove 300 of the preferred invention is a cotton glove 300, made with the standard weaving process as the gloves worn by football players, but can also be made of vinyl or leather. Glove 300 palm area 302 and each of the fingers 304 have VELCRO strips 306 affixed to them either by stitching or adhesive. In the preferred embodiment, there are three horizontal VELCRO strips 306 on the palm area 302, stitched to the glove 300 and each joint of the fingers 304 has strips 308 of the VELCRO hook material secured to it. The VELCRO strips 306 on fingers 304 interact with the VELCRO strips 108 on the football grooves 102, effecting a spiral motion of the football 100 and causing the football 100 to go straight and with greater velocity.

In a preferred embodiment of the present invention, the foam football 100, shown in FIGS. 1, 2, 3, 6 and 7, has a plurality of whistles 110 attached at a point midway between the ends 106 of the football 100, although the football 100 can also be made without any whistles 110. When the player throws or kicks the football 100, air travels into a sound chamber 114 of the whistle 110 causing a vibration deviation which thereby produces sound. The whistle 110 may be attached using adhesive or snugly received by the football 100. In the preferred embodiment, two whistles 110 are equipped with anchors, not shown, inserted inside the football 100, and embedded inside the foam. The whistles 110 are made durable enough to withstand the forces that may be applied to the football 100. The outer plates 113 of the whistles 110 may extend outward from the surface of the football 100, as shown in FIG. 3. Two small slot-like airflow openings 112 are defined in outer plates 113 of the whistles 110 for air to pass into the sound chamber 114. Once air enters the whistle 110, it travels in a turbulent motion within the sound chamber 114 thereby producing sound.

In a preferred embodiment, the VELCRO strips 108 in the grooves 102 of the football 100, and the flags 404 are colored with a non-toxic fluorescent glow-type coating which produces a glow effect in a darkened environment, enhancing the entertainment effect of the game.

While the proffered embodiments have been described and illustrated, various modifications and substitutions may be made thereto without departing from the scope of the invention. Accordingly, it should be understood that the present invention has been described by way of illustration and not limitation.

What is claimed is:

1. Flag football game equipment comprising:

a belt with a plurality of interlocking fasteners at its ends; a plurality of flags detachably secured to said belt and capable of swinging freely therefrom by attachment means comprising co-acting hook fabric fasteners on said belt and loop fabric fasteners on said flags; an elliptical football formed of foam rubber, having two ends and a plurality of longitudinally extending elliptic-helical grooves substantially equally spaced apart around the periphery of said football, said grooves being wide and deep enough to receive the gripping fingers of a player therein, some of said grooves containing a loop material for interlocking engagement with a catching glove; and a catching glove including hook fabric fasteners adapted for interlocking engagement with the loop fabric fasteners on said football and flags.

2. The invention as set forth in claim 1 above, wherein said elliptical football has precisely twelve equidistant, longitudinal elliptic-helical grooves, wide and deep enough to allow gripping and improve passing of said elliptical football.

3. The invention as set forth in claim 2 above, wherein said grooves become narrower and shallower towards the elliptical football's ends.

4. The invention as set forth in claim 2 above, wherein each of said grooves is U-shaped with two slanted walls and an approximately horizontal bottom.

5. The invention as set forth in claim 4 above, wherein every second said groove is completely covered with loop fabric fastener.

6. The invention as set forth in claim 5 above, wherein said loop fabric fasteners in the grooves of the elliptical football are colored with a non-toxic fluorescent glow-type coating.

7. The invention as set forth in claim 4 above, wherein every second said groove's two slanted walls are covered with loop fabric fastener.

8. The invention as set forth in claim 7 above, wherein said loop fabric fasteners in the grooves of the elliptical football are colored with a non-toxic fluorescent glow-type coating.

9. The invention as set forth in claim 1 above, wherein the elliptical football further comprises a plurality of whistles anchored inside the elliptical football in order to produce a whistling sound when said elliptical football is moved through the air in a spiral rotation.

10. The invention as set forth in claim 9 above, wherein said whistles are located at a point midway between said elliptical football's ends.

11. The invention as set forth in claim 1 above, wherein said belt and said flag are made of cloth or nylon.

12. The invention as set forth in claim 1 above, wherein said flag has a length of 12 to 22 inches.

13. The invention as set forth in claim 1 above, wherein said belt is made of a material capable of being detachably secured to the fasteners at the ends of the belt.

14. The invention as set forth in claim 1 above, wherein the fasteners at one end of said belt are attached to the inside of the belt and the fasteners at the other end of the belt are attached to the outside of the belt.

15. The invention as set forth in claim 1 above, wherein said flag is completely covered with a loop material colored with a non-toxic fluorescent glow-type coating.

16. The invention as set forth in claim 1 above, wherein the catching glove having plurality of strips of hook material permanently attached to the palm side of each joint of the fingers and the palm of the glove.

* * * * *